US011833641B2

(12) United States Patent
Sasaki

(10) Patent No.: US 11,833,641 B2
(45) Date of Patent: Dec. 5, 2023

(54) CLEANING METHOD FOR OPTICAL SURFACE MONITORING DEVICE

(71) Applicant: EBARA CORPORATION, Tokyo (JP)

(72) Inventor: Toshimitsu Sasaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 528 days.

(21) Appl. No.: 16/901,843

(22) Filed: Jun. 15, 2020

(65) Prior Publication Data

US 2021/0008681 A1 Jan. 14, 2021

(30) Foreign Application Priority Data

Jun. 26, 2019 (JP) ..... 2019-118276

(51) Int. Cl.
*B24B 7/24* (2006.01)
*B24B 37/20* (2012.01)
*B24B 37/04* (2012.01)

(52) U.S. Cl.
CPC ..... *B24B 7/241* (2013.01); *B24B 37/042* (2013.01); *B24B 37/20* (2013.01)

(58) Field of Classification Search
CPC ..... B24B 7/241; B24B 37/042; B24B 37/20; B24B 49/12; B24B 49/04; B24B 37/34; B24B 37/04; B24B 53/017
USPC ..... 451/41
See application file for complete search history.

(56) References Cited

U.S. PATENT DOCUMENTS

2003/0205325 A1* 11/2003 Boyd ..... B24B 49/12 156/345.12
2006/0105679 A1* 5/2006 Hirokawa ..... B24B 37/013 451/6
2014/0182633 A1* 7/2014 Lin ..... B24B 55/00 134/36
2018/0019496 A1* 1/2018 Konopka ..... H01M 4/00

FOREIGN PATENT DOCUMENTS

CN 102554783 A * 7/2012 ..... B24B 53/017
CN 104742007 A * 7/2015 ..... B24B 37/04
CN 107116400 A * 9/2017 ..... B24B 1/100
(Continued)

OTHER PUBLICATIONS

English translation of CN 107116400A (Year: 2017).*
(Continued)

*Primary Examiner* — Joel D Crandall
*Assistant Examiner* — Sukwoo James Chang
(74) *Attorney, Agent, or Firm* — BakerHostetler

(57) ABSTRACT

A cleaning method capable of removing abrasive grains adhering to a light passage provided in a polishing table is disclosed. The cleaning method includes: while supplying slurry containing abrasive grains onto a polishing pad supported by a polishing table, placing a substrate in sliding contact with the polishing pad to polish the substrate; during polishing of the substrate, directing light to the substrate through a light passage provided in the polishing table, and causing reflected light from the substrate to pass through the light passage; removing the polished substrate from the polishing pad; and supplying a chemical liquid into the light passage when the substrate is not present on the polishing pad to remove the abrasive grains adhering to the light passage by the chemical liquid.

4 Claims, 7 Drawing Sheets

(56) References Cited

FOREIGN PATENT DOCUMENTS

| | | | | | |
|---|---|---|---|---|---|
| CN | 107845590 | A | * | 3/2018 | |
| CN | 109155249 | A | * | 1/2019 | ..... B24B 37/26 |
| CN | 208514315 | U | * | 2/2019 | ..... B24B 37/34 |
| JP | 2006-525878 | A | | 11/2006 | |
| JP | 2016-113356 | A | | 6/2016 | |
| WO | WO 2004/101223 | A1 | | 11/2004 | |

OTHER PUBLICATIONS

English translation of CN 102554783A (Year: 2012).*
English translation of CN 107845590A (Year: 2018).*
English translation of CN 208514315U (Year: 2019).*
English translation of CN 104742007A (Year: 2015).*
English translation of CN 109155249A (Year: 2019).*

* cited by examiner

CLEANING METHOD FOR OPTICAL SURFACE MONITORING DEVICE

CROSS REFERENCE TO RELATED APPLICATION

This document claims priority to Japanese Patent Application Number 2019-118276 filed Jun. 26, 2019, the entire contents of which are hereby incorporated by reference.

BACKGROUND

A semiconductor device manufacturing process includes various steps, such as polishing of a dielectric film (e.g., $SiO_2$) and polishing of a metal film (e.g., copper or tungsten). Wafer polishing is performed using a polishing apparatus. This polishing apparatus generally includes a polishing table that supports a polishing pad, a polishing head for pressing a wafer against the polishing pad, and a slurry supply nozzle for supplying slurry onto the polishing pad. While the polishing table is rotating, the slurry is supplied onto the polishing pad on the polishing table, and the polishing head presses the wafer against the polishing pad. The wafer is placed in sliding contact with the polishing pad in the presence of the slurry. The surface of the wafer is planarized by a combination of the chemical action of the slurry and the mechanical action of the abrasive grains contained in the slurry.

The polishing of the wafer is terminated when a thickness of a film (e.g., a dielectric film, a metal film, a silicon layer, etc.), forming the surface of the wafer, reaches a predetermined target value. The polishing apparatus typically includes an optical surface-monitoring device to measure a thickness of a non-metallic film, such as a dielectric film or a silicon layer. This optical surface-monitoring device is configured to direct light, emitted from a light source, to the surface of the wafer, measure intensity of reflected light from the wafer with a spectrometer, and analyze a spectrum of the reflected light to determine a surface condition of the wafer (for example, to measure the film thickness of the wafer, or to detect removal of the film that forms the surface of the wafer).

Optical fiber cables coupled to the light source and the spectrometer are provided in the polishing table. In addition, a light passage coupled to the optical fiber cables is also provided in the polishing table. The light travels through the light passage and is incident on the wafer. The reflected light from the wafer travels in the opposite direction through the light passage. In order to prevent the slurry that has been supplied to the polishing pad from entering the light passage, a flow of pure water is formed in the light passage during polishing of the wafer.

However, when the supply of pure water to the light passage is interrupted due to a failure of a pure-water supply system or other cause, the slurry enters the light passage, and the abrasive grains contained in the slurry adhere to an inner surface of the light passage. Such abrasive grains can cause a change in a manner of traveling of the light through the light passage, and as a result, the spectrometer cannot correctly measure the intensity of the reflected light from the wafer. In particular, the abrasive grains firmly adhering to the inner surface of the light passage cannot be washed away with the pure water. As a result, it is necessary to replace the light passage and optical fiber cables as a whole with new one.

SUMMARY OF THE INVENTION

Therefore, there is provided a cleaning method capable of removing abrasive grains adhering to a light passage provided in a polishing table.

Embodiments, which will be described below, relate to a method of cleaning an optical surface-monitoring device provided in a polishing apparatus for polishing a substrate such as a wafer, and more particularly relate to a method of removing abrasive grains of slurry adhering to a light passage provided in a polishing table.

In an embodiment, there is provided a cleaning method comprising: while supplying slurry containing abrasive grains onto a polishing pad supported by a polishing table, placing a substrate in sliding contact with the polishing pad to polish the substrate; during polishing of the substrate, directing light to the substrate through a light passage provided in the polishing table, and causing reflected light from the substrate to pass through the light passage; removing the polished substrate from the polishing pad; and supplying a chemical liquid into the light passage when the substrate is not present on the polishing pad to remove the abrasive grains adhering to the light passage by the chemical liquid.

In an embodiment, the cleaning method further comprises after removing the abrasive grains, supplying a drying gas into the light passage to dry the light passage.

In an embodiment, the cleaning method further comprises after supplying the chemical liquid into the light passage and before supplying the drying gas into the light passage, supplying pure water into the light passage.

In an embodiment, the cleaning method further comprises after removing the polished substrate from the polishing pad and before supplying the chemical liquid into the light passage, supplying pure water into the light passage.

In an embodiment, there is provided a cleaning method comprising: while supplying slurry containing abrasive grains onto a polishing pad supported by a polishing table, placing a substrate in sliding contact with the polishing pad to polish the substrate; during polishing of the substrate, directing light to the substrate through a light passage provided in the polishing table, and causing reflected light from the substrate to pass through the light passage; removing the polished substrate from the polishing pad; and supplying pure water into the light passage when the substrate is not present on the polishing pad to remove the abrasive grains adhering to the light passage; and then supplying a drying gas into the light passage to dry the light passage.

The chemical liquid slightly etches the inner surface of the light passage and can therefore remove abrasive grains from the light passage by a lift-off action. Therefore, the light can travel in the light passage without being affected by the abrasive grains. As a result, the optical surface-monitoring device can accurately detect a surface condition of a substrate, such as a wafer. In addition, the light passage is dried by the drying gas, which can keep the light passage in good conditions.

When the abrasive grains contained in the slurry do not firmly adhere to the light passage (e.g., immediately after the slurry has just entered the light passage), the abrasive grains can be washed away from the light passage with the pure water instead of the chemical liquid. The light can travel in the light passage without being affected by the abrasive grains. As a result, the optical surface-monitoring device can accurately detect a surface condition of a substrate, such as a wafer.

DESCRIPTION OF EMBODIMENTS

Figure 1:
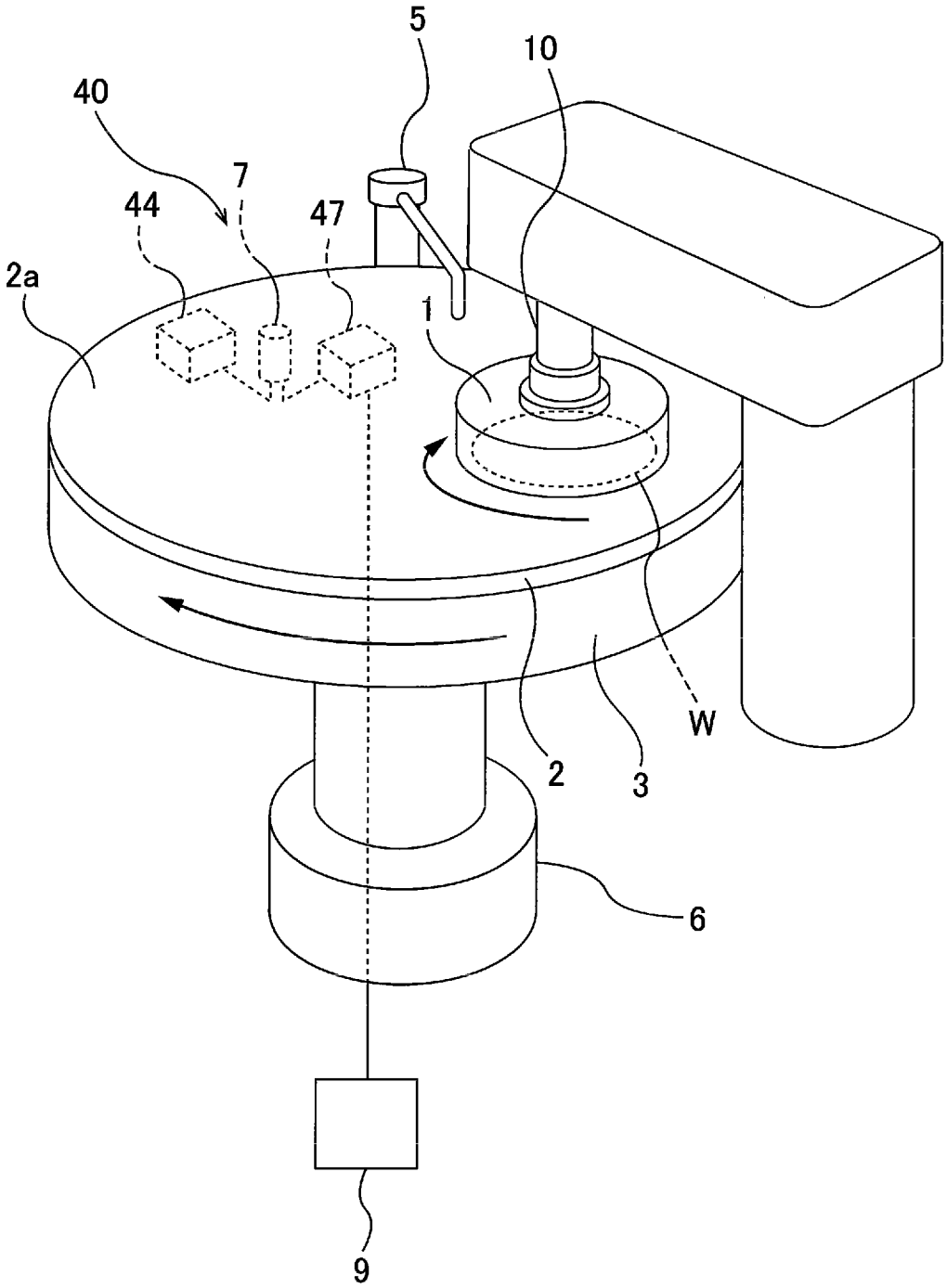
FIG. 1 is a schematic view showing an embodiment of a polishing apparatus.

Embodiments will be described below with reference to the drawings. FIG. 1 is schematic view showing an embodiment of a polishing apparatus. As shown in FIG. 1, the polishing apparatus includes a polishing table 3 for supporting a polishing pad 2, a polishing head 1 configured to press a wafer W, which is an example of a substrate, against the polishing pad 2, a table motor 6 configured to rotate the polishing table 3, and a slurry supply nozzle 5 arranged to supply slurry onto the polishing pad 2.

The polishing head 1 is coupled to a head shaft 10, and the polishing head 1 rotates together with the head shaft 10 in a direction indicated by an arrow. The polishing table 3 is coupled to the table motor 6, which is configured to rotate the polishing table 3 and the polishing pad 2 in a direction indicated by an arrow. The polishing pad 2 has an upper surface constituting a polishing surface 2*a* for polishing the wafer W.

Polishing of the wafer W is performed as follows. The slurry supply nozzle 5 supplies the slurry onto the polishing surface 2*a* of the polishing pad 2 on the polishing table 3, while the polishing table 3 and the polishing head 1 are rotated in directions indicated by the arrows in FIG. 1. While the wafer W is being rotated by the polishing head 1, the wafer W is pressed against the polishing surface 2*a* of the polishing pad 2 in the presence of the slurry on the polishing pad 2. The surface of the wafer W is polished by a chemical action of the slurry and a mechanical action of abrasive grains contained in the slurry.

The polishing apparatus includes an optical surface-monitoring device 40 configured to detect a surface condition of the wafer W. The optical surface-monitoring device 40 includes an optical sensor head 7, a light source 44, a spectrometer 47, and a processing device 9. The optical sensor head 7, the light source 44, and the spectrometer 47 are secured to the polishing table 3, and rotate together with the polishing table 3 and the polishing pad 2. The position of the optical sensor head 7 is such that the optical sensor head 7 sweeps across the surface of the wafer W on the polishing pad 2 each time the polishing table 3 and the polishing pad 2 make one rotation.

Figure 2:
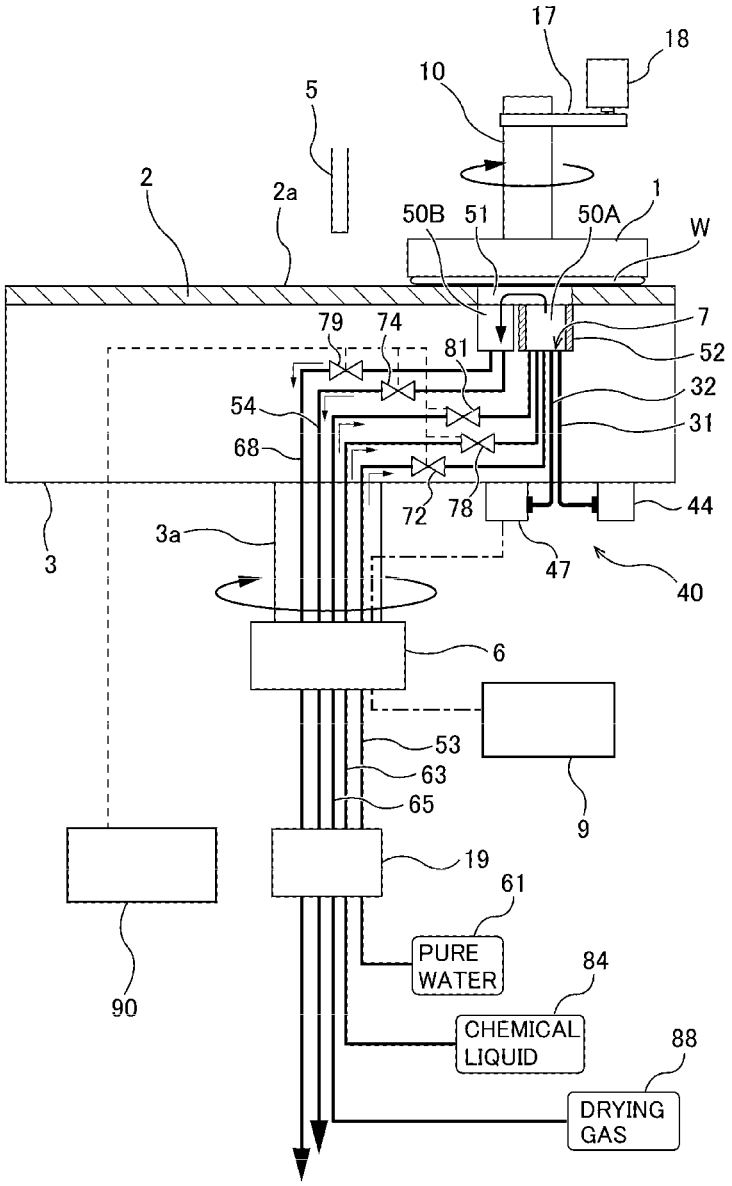
FIG. 2 is a cross-sectional view showing an embodiment of detailed configurations of the polishing apparatus shown in FIG. 1.

FIG. 2 is a cross-sectional view showing an embodiment of detailed configurations of the polishing apparatus shown in FIG. 1. The head shaft 10 is coupled to a polishing head motor 18 through a coupling device 17, such as belt, so that the head shaft 10 is rotated by the polishing head motor 18. This rotation of the head shaft 10 is transmitted to the polishing head 1 to rotate the polishing head 1 in the direction indicated by the arrow.

The optical sensor head 7 is optically coupled to the light source 44 and the spectrometer 47. The spectrometer 47 is electrically coupled to the processing device 9. The processing device 9 is composed of a computer, which includes a memory that stores a program therein and an arithmetic device (e.g., CPU) that performs arithmetic operations in accordance with instructions included in the program.

The optical surface-monitoring device 40 further includes a light-emitting optical fiber cable 31 arranged to direct the light, emitted by the light source 44, to the surface of the wafer W, and a light-receiving optical fiber cable 32 arranged to receive the reflected light from the wafer W and transmit the reflected light to the spectrometer 47. An end of the light-emitting optical fiber cable 31 and an end of the light-receiving optical fiber cable 32 are located in the polishing table 3.

The end of the light-emitting optical fiber cable 31 and the end of the light-receiving optical fiber cable 32 constitute the optical sensor head 7 that directs the light to the surface of the wafer W and receives the reflected light from the wafer W. The other end of the light-emitting optical fiber cable 31 is coupled to the light source 44, and the other end of the light-receiving optical fiber cable 32 is coupled to the spectrometer 47. The spectrometer 47 is configured to decompose the reflected light from the wafer W according to wavelength and measure intensities of the reflected light over a predetermined wavelength range.

The light source 44 transmits the light to the optical sensor head 7 through the light-emitting optical fiber cable 31, and the optical sensor head 7 emits the light to the wafer W. The reflected light from the wafer W is received by the optical sensor head 7 and transmitted to the spectrometer 47 through the light-receiving optical fiber cable 32. The spectrometer 47 decomposes the reflected light according to its wavelength and measures the intensity of the reflected light at each of the wavelengths. The spectrometer 47 sends intensity measurement data of the reflected light to the processing device 9.

The processing device 9 produces a spectrum of the reflected light from the intensity measurement data of the reflected light. This spectrum indicates a relationship between the intensity and the wavelength of the reflected light, and the shape of the spectrum varies according to a film thickness of the wafer W. The processing device 9 determines the film thickness of the wafer W based on the spectrum of the reflected light. A known technique is used to determine the film thickness of the wafer W based on the spectrum of the reflected light. For example, the processing device 9 may perform Fourier transform on the spectrum of the reflected light to obtain a frequency spectrum and determine a film thickness from the frequency spectrum obtained.

During polishing of the wafer W, the optical sensor head 7 irradiates a plurality of measurement points on the wafer W with the light and receives the reflected light from the wafer W while the optical sensor head 7 is sweeping across the surface of the wafer W on the polishing pad 2, every time the polishing table 3 makes one revolution. The processing device 9 generates a spectrum of the reflected light from the measurement data of the intensity of the reflected light, determines the film thickness of the wafer W from the spectrum of the reflected light, and controls the polishing operation for the wafer W based on the film thickness. For example, the processing device 9 determines a polishing end point of the wafer W at which the film thickness of the wafer W reaches a target film thickness.

In one embodiment, the processing device 9 may detect a point in time of removal of the film that forms the surface of the wafer W from a change in the spectrum of the reflected light. In this case, the processing device 9 determines the polishing end point based on the point in time at which the film that forms the surface of the wafer W is removed. The processing device 9 may not determine the film thickness of the wafer W from the spectrum of the reflected light.

The polishing table 3 has a light passage 50A and a drain hole 50B which are open at the upper surface of the polishing table 3. The light passage 50A is constituted by a cylindrical body 52 made of metal or resin. The end of the light-emitting optical fiber cable 31 and the end of the light-receiving optical fiber cable 32 are optically coupled to the light passage 50A. The drain hole 50B is adjacent to the light passage 50A and is located inside the polishing table 3.

The polishing pad 2 has a through-hole 51 which is in fluid communication with both the light passage 50A and the drain hole 50B. This through-hole 51 is located over the light passage 50A and the drain hole 50B. The through-hole 51 opens in the polishing surface 2*a*. The light passage 50A is coupled to a pure-water supply line 53, and the drain hole 50B is coupled to a pure-water discharge line 54. The optical sensor head 7, composed of the end of the light-emitting optical fiber cable 31 and the end of the light-receiving optical fiber cable 32, is located beneath the light passage 50A and the through-hole 51.

The light emitted from the light source 44 is transmitted through the light-emitting optical fiber cable 31, further travels through the light passage 50A, and is incident on the surface of the wafer W. The light is reflected off the surface (i.e., the surface to be polished) of the wafer W to form reflected light, which travels in the opposite direction in the light passage 50A. The reflected light from the wafer W travels through the light-receiving optical fiber cable 32 and is received by the spectrometer 47. The spectrometer 47 measures the intensity of the reflected light at each wavelength over a predetermined wavelength range, and sends the intensity measurement data obtained to the processing device 9. The intensity measurement data is a film thickness signal that changes according to the film thickness of the wafer W. The processing device 9 generates a spectrum of the reflected light representing the intensity of light at each of wavelengths from the intensity measurement data, and further determines the film thickness of the wafer W from the spectrum of the reflected light.

The optical sensor head 7, composed of the distal end of the light-emitting optical fiber cable 31 and the distal end of the light-receiving optical fiber cable 32, is arranged so as to face the wafer W held by the polishing head 1, so that multiple measurement points of the wafer W are irradiated with the light each time the polishing table 3 makes one revolution. Only one optical sensor head 7 is provided in this embodiment, while a plurality of optical sensor heads 7 may be provided.

During the polishing of the wafer W, pure water as a rinsing liquid is supplied through the pure-water supply line 53 into the light passage 50A, and is further supplied into the through-hole 51 through the light passage 50A. The pure water fills a space between the surface (i.e., the surface to be polished) of the wafer W and the optical sensor head 7. The pure water flows into the drain hole 50B and is discharged through the pure-water discharge line 54. The pure water flowing in the light passage 50A and the through-hole 51 prevents the slurry from entering the light passage 50A.

The end of the pure-water supply line 53 is coupled to the light passage 50A, and the other end of the pure-water supply line 53 is coupled to a pure-water supply source 61. The end of the pure-water discharge line 54 is coupled to the drain hole 50B. The pure water supplied to the through-hole 51 flows through the drain hole 50B, further flows through the pure-water discharge line 54, and is then discharged to the outside of the polishing apparatus.

A chemical-liquid supply line 63 and a drying-gas supply line 65 are further coupled to the light passage 50A. A chemical-liquid discharge line 68 is further coupled to the drain hole 50B. Respective ends of the pure-water supply line 53, the chemical-liquid supply line 63, the drying-gas supply line 65, the pure-water discharge line 54, and the chemical-liquid discharge line 68 are located in the polishing table 3, and the other ends are located outside the polishing table 3. The pure-water supply line 53, the chemical-liquid supply line 63, the drying-gas supply line 65, the pure-water discharge line 54, and the chemical-liquid discharge line 68 extend through a rotary joint 19.

A pure-water supply valve 72 is attached to the pure-water supply line 53, and a pure-water discharge valve 74 is attached to the pure-water discharge line 54. A chemical-liquid supply valve 78 is attached to the chemical-liquid supply line 63, and a chemical-liquid discharge valve 79 is attached to the chemical-liquid discharge line 68. A drying-gas supply valve 81 is attached to the drying-gas supply line 65. Each of the pure-water supply valve 72, the pure-water discharge valve 74, the chemical-liquid supply valve 78, the chemical-liquid discharge valve 79, and the drying-gas supply valve 81 is an actuator-driven valve, such as an electric valve, a solenoid valve, or an air-operated valve.

The pure-water supply valve 72, the pure-water discharge valve 74, the chemical-liquid supply valve 78, the chemical-liquid discharge valve 79, and the drying-gas supply valve 81 are coupled to a valve controller 90. The valve controller 90 is configured to control the operations of the pure-water supply valve 72, the pure-water discharge valve 74, the chemical-liquid supply valve 78, the chemical-liquid discharge valve 79, and the drying-gas supply valve 81. The valve controller 90 is constituted by a computer, which includes a memory that stores a program therein and an arithmetic device (e.g., CPU) that performs arithmetic operations according to instructions included in the program.

A chemical liquid has a chemical property of etching an inner surface of the light passage 50A. Specifically, the chemical liquid slightly etches the inner surface of the light passage 50A, and can therefore remove the abrasive grains from the light passage 50A by a lift-off action. Examples of the chemical liquid used in this embodiment include a solution containing potassium hydroxide. However, the type of the chemical liquid is not limited to this embodiment, as long as the chemical liquid can etch the inner surface of the light passage 50A. The chemical-liquid supply line 63 is coupled to a chemical-liquid supply source 84.

A drying gas is a gas for expelling liquid (the pure water and/or the chemical liquid) from the light passage 50A and further drying the light passage 50A. Examples of the drying gas used in this embodiment include dry air and an inert gas (e.g., nitrogen gas). The drying-gas supply line 65 is coupled to a drying-gas supply source 88, such as an air supply source or an inert-gas supply source.

During polishing of the wafer W, the chemical-liquid supply valve 78, the chemical-liquid discharge valve 79, and the drying-gas supply valve 81 are closed, and the pure-water discharge valve 74 is open. The pure-water supply valve 72 is opened and closed in synchronization with the rotation of the polishing table 3. More specifically, the valve controller 90 opens the pure-water supply valve 72 when the through-hole 51 of the polishing pad 2 rotating with the polishing table 3 is located under the wafer W. The pure water flows through the pure-water supply line 53 into the light passage 50A and flows through the light passage 50A and the through-hole 51. Further, the pure water flows from the through-hole 51 into the drain hole 50B, and is discharged from the polishing apparatus through the pure-water discharge line 54. When the through-hole 51 of the polishing pad 2 rotating with the polishing table 3 is not under the wafer W, the valve controller 90 closes the pure-water supply valve 72.

When the through-hole 51 is under the wafer W, i.e. when the light passage 50A is under the wafer W, the light-emitting optical fiber cable 31 directs the light to the surface of the wafer W through the light passage 50A, and the light-receiving optical fiber cable 32 receives the reflected light from the wafer W passing through the light passage 50A. Since the light passage 50A is filled with the pure water which is a transparent liquid, the slurry does not enter the light passage 50A and a good optical path is ensured.

When the polishing of the wafer W using the slurry is terminated, the polished wafer W is removed from the polishing pad 2 by the polishing head 1. The polished wafer W is transferred from the polishing head 1 to a transporting device (not shown), and is cleaned by a cleaning unit (not shown).

When the supply of the pure water to the light passage 50A is interrupted due to a malfunction of the pure-water supply source 61 or a failure of the pure-water supply valve 72, the slurry that has been supplied to the polishing pad 2 enters the light passage 50A. The abrasive grains contained in the slurry may adhere to the inner surface of the light passage 50A. Such abrasive grains change the manner of traveling of the light through the light passage 50A. As a result, the spectrometer 47 cannot correctly measure the intensity of the reflected light from the wafer W.

Figure 3:
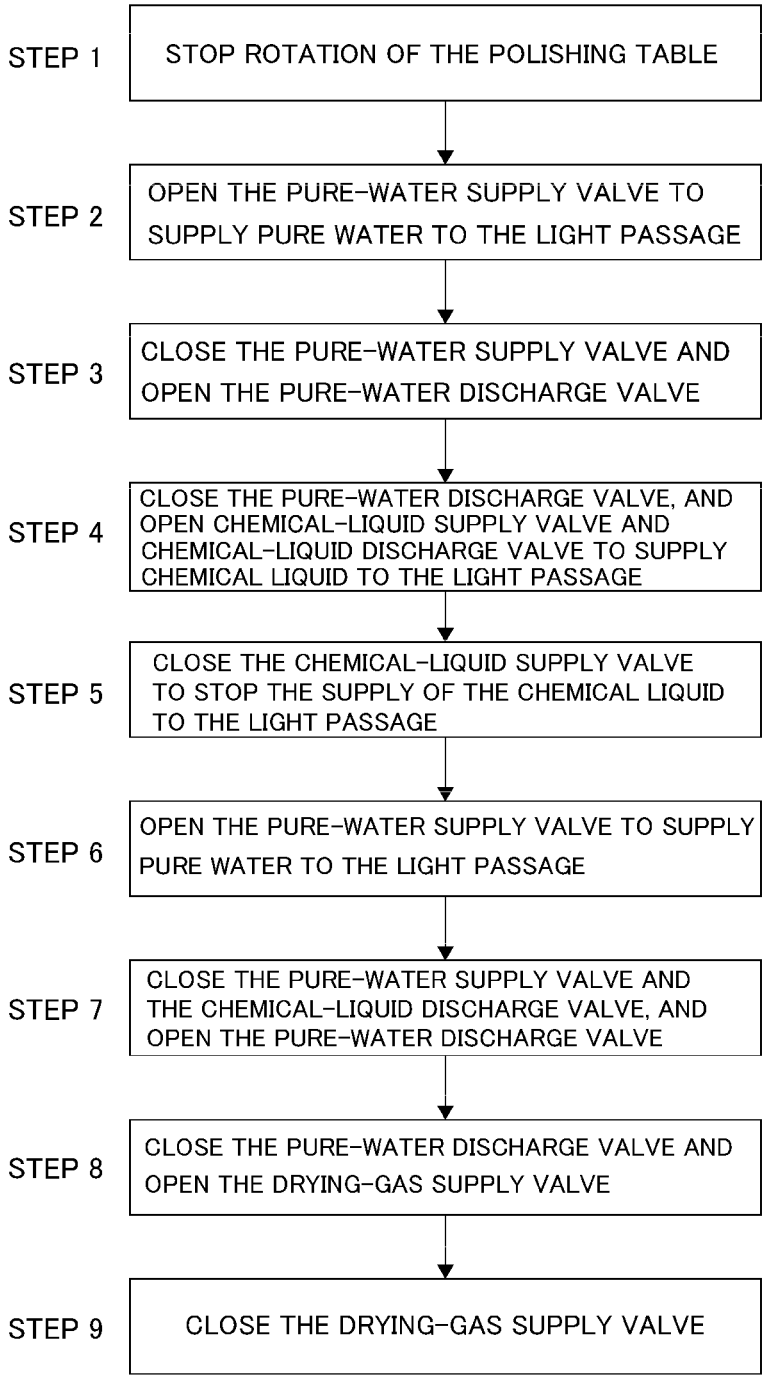
FIG. 3 is a flowchart showing an embodiment of removing abrasive grains from a light passage.

Thus, in one embodiment, the abrasive grains are removed from the light passage 50A according to a flowchart shown in FIG. 3.

In step 1, after the wafer W is polished, the rotation of the polishing table 3 is stopped.

In step 2, the valve controller 90 opens the pure-water supply valve 72 when the wafer W is not present on the polishing pad 2. The chemical-liquid supply valve 78, the chemical-liquid discharge valve 79, the pure-water discharge valve 74, and the drying-gas supply valve 81 are closed. The pure water flows through the pure-water supply line 53 into the light passage 50A, further flows through the through-hole 51, and overflows onto the polishing pad 2. The slurry existing in the light passage 50A flows onto the polishing pad 2 together with the pure water. Since the pure-water discharge valve 74 is closed, the slurry does not flow through the pure-water discharge line 54. This is to prevent the pure-water discharge line 54 from being clogged with the abrasive grains contained in the slurry.

In step 3, after a predetermined pure-water supply time has elapsed, the valve controller 90 closes the pure-water supply valve 72 and opens the pure-water discharge valve 74. The pure water in the through-hole 51 is discharged through the drain hole 50B and the pure-water discharge line 54. Since almost no slurry remains in the through-hole 51, the pure-water discharge line 54 is not clogged with the abrasive grains.

In step 4, the valve controller 90 closes the pure-water discharge valve 74 and opens the chemical-liquid supply valve 78 and the chemical-liquid discharge valve 79. The chemical liquid is supplied to the light passage 50A through the chemical-liquid supply line 63 and fills the light passage 50A. Further, the chemical liquid flows through the through-hole 51 into the drain hole 50B and is discharged through the chemical-liquid discharge line 68. The abrasive grains firmly adhering to the inner surface of the light passage 50A are removed by the chemical liquid.

In step 5, the valve controller 90 closes the chemical-liquid supply valve 78 to stop the supply of the chemical liquid to the light passage 50A, while keeping the chemical-liquid discharge valve 79 open. The chemical liquid in the through-hole 51 is discharged through the drain hole 50B and the chemical-liquid discharge line 68.

In step 6, the valve controller 90 opens the pure-water supply valve 72 while keeping the chemical-liquid discharge valve 79 open. The pure water pushes out the chemical liquid remaining in the light passage 50A, so that the chemical liquid is discharged together with the pure water through the drain hole 50B and the chemical-liquid discharge line 68. The light passage 50A is rinsed with the pure water.

In step 7, the valve controller 90 closes the pure-water supply valve 72 and the chemical-liquid discharge valve 79, and opens the pure-water discharge valve 74. The pure water in the through-hole 51 is discharged through the drain hole 50B and the pure-water discharge line 54.

In step 8, the valve controller 90 closes the pure-water discharge valve 74 and opens the drying-gas supply valve 81. The drying gas, such as dry air or nitrogen gas, is supplied through the drying-gas supply line 65 into the light passage 50A to push out the pure water existing in the light passage 50A. The supply of the drying gas is continued for a predetermined gas supply time. This gas supply time is long enough for the drying gas to push the pure water out of the light passage 50A and dry the inside of the light passage 50A.

In step 9, the valve controller 90 closes the drying-gas supply valve 81 after the gas supply time has elapsed.

According to this embodiment, the abrasive grains are removed from the light passage 50A by the chemical liquid, and the light passage 50A is dried by the drying gas. Therefore, the light passage 50A can be maintained in a good condition. In particular, the present embodiment is suitable in a case where the polishing apparatus is not used for a long period of time after the abrasive grains have been removed from the light passage 50A. The present embodiment is performed, for example, immediately before the polishing pad 2 is replaced with a new polishing pad.

Figure 4:
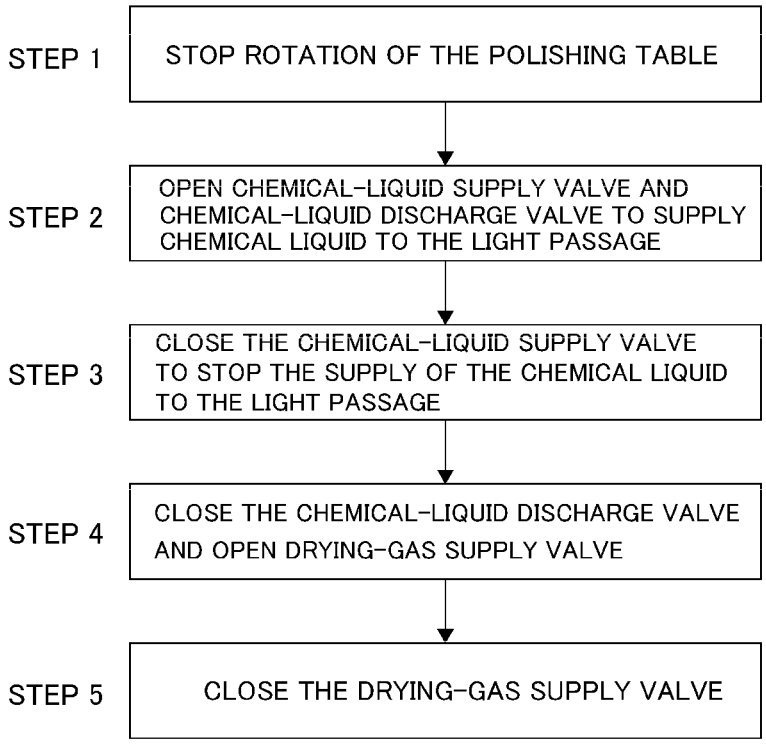
FIG. 4 is a flowchart showing another embodiment of removing abrasive grains from the light passage.

FIG. 4 is a flowchart showing another embodiment for removing the abrasive grains from the light passage 50A.

In step 1, after the wafer is polished, the rotation of the polishing table 3 is stopped.

In step 2, the valve controller 90 opens the chemical-liquid supply valve 78 and the chemical-liquid discharge valve 79 when the wafer is not present on the polishing pad 2. The pure-water supply valve 72, the pure-water discharge valve 74, and the drying-gas supply valve 81 are closed. The chemical liquid flows through the chemical-liquid supply line 63 into the light passage 50A, further flows through the through-hole 51, and overflows onto the polishing pad 2. The slurry existing in the light passage 50A flows onto the polishing pad 2 together with the chemical liquid. The abrasive grains firmly adhering to the inner surface of the light passage 50A are removed by the chemical liquid.

In step 3, the valve controller 90 closes the chemical-liquid supply valve 78 while keeping the chemical-liquid discharge valve 79 open, and stops the supply of the chemical liquid to the light passage 50A. The chemical liquid in the through-hole 51 is discharged through the drain hole 50B and the chemical-liquid discharge line 68.

In step 4, the valve controller 90 closes the chemical-liquid discharge valve 79 and opens the drying-gas supply valve 81. The drying gas, such as dry air or nitrogen gas, is supplied through the drying-gas supply line 65 into the light passage 50A to push out the chemical liquid existing in the light passage 50A. The supply of the drying gas is continued for a predetermined gas supply time. This gas supply time is long enough for the drying gas to push the chemical liquid out of the light passage 50A and dry the inside of the light passage 50A.

In step 5, the valve controller 90 closes the drying-gas supply valve 81 after the gas supply time has elapsed.

The present embodiment is performed in a case of using a type of chemical liquid that does not necessitate the rinsing step of washing the chemical liquid away from the light passage 50A with the pure water. Also in this embodiment, the abrasive grains are removed from the light passage 50A by the chemical liquid, and the light passage 50A is dried by the drying gas. Therefore, the light passage 50A can be maintained in a good condition. In particular, the present embodiment is suitable in a case where the polishing apparatus is not used for a long period of time after the abrasive grains have been removed from the light passage 50A. The present embodiment is performed, for example, immediately before the polishing pad 2 is replaced with a new polishing pad.

Figure 5:
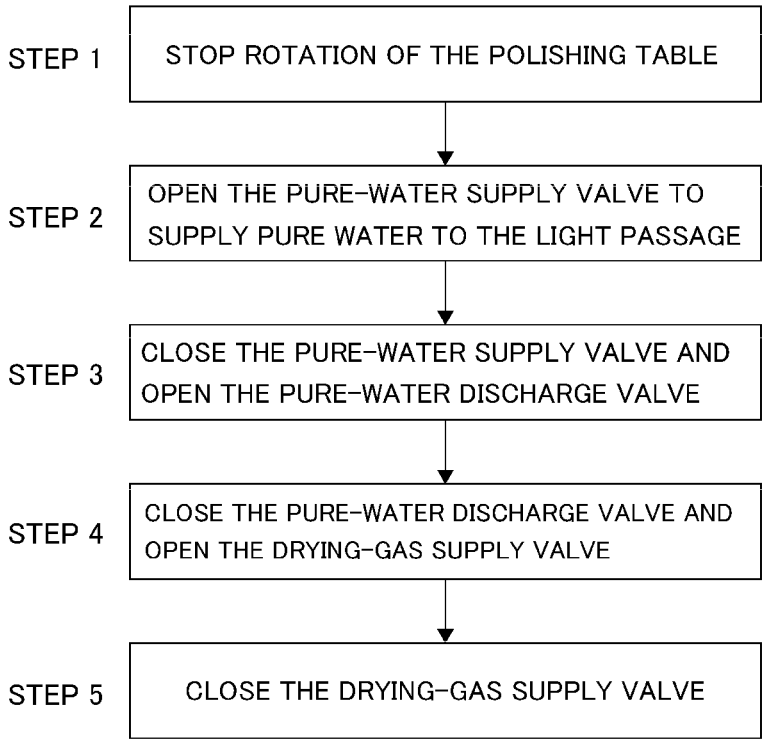
FIG. 5 is a flowchart showing still another embodiment of removing abrasive grains from the light passage.

FIG. 5 is a flowchart showing still another embodiment for removing the abrasive grains from the light passage 50A.

In step 1, after the wafer is polished, the rotation of the polishing table 3 is stopped.

In step 2, the valve controller 90 opens the pure-water supply valve 72 when the wafer is not present on the polishing pad 2. The chemical-liquid supply valve 78, the chemical-liquid discharge valve 79, the pure-water discharge valve 74, and the drying-gas supply valve 81 are closed. The pure water flows through the pure-water supply line 53 into the light passage 50A, further flows through the through-hole 51, and overflows onto the polishing pad 2. The slurry existing in the light passage 50A flows onto the polishing pad 2 together with the pure water.

In step 3, after a predetermined pure-water supply time has elapsed, the valve controller 90 closes the pure-water supply valve 72 and opens the pure-water discharge valve 74. The pure water in the through-hole 51 is discharged through the drain hole 50B and the pure-water discharge line 54.

In step 4, the valve controller 90 closes the pure-water discharge valve 74 and opens the drying-gas supply valve 81. The drying gas, such as dry air or nitrogen gas, is supplied through the drying-gas supply line 65 into the light passage 50A to push out the pure water existing in the light passage 50A. The supply of the drying gas is continued for a predetermined gas supply time. This gas supply time is long enough for the drying gas to push the pure water out of the light passage 50A and dry the inside of the light passage 50A.

In step 5, the valve controller 90 closes the drying-gas supply valve 81 after the gas supply time has elapsed.

In this embodiment, no chemical is used to remove the abrasive grains. The present embodiment is performed immediately after the slurry has entered the light passage 50A. More specifically, the operations of the present embodiment are performed before the abrasive grains contained in the slurry firmly adhere to the light passage 50A. The abrasive grains are removed from the light passage 50A with the pure water, and the light passage 50A is dried with the drying gas. Therefore, the light passage 50A can be maintained in a good condition. In particular, the present embodiment is suitable in a case where the polishing apparatus is not used for a long period of time after the abrasive grains have been removed from the light passage 50A.

Figure 6:
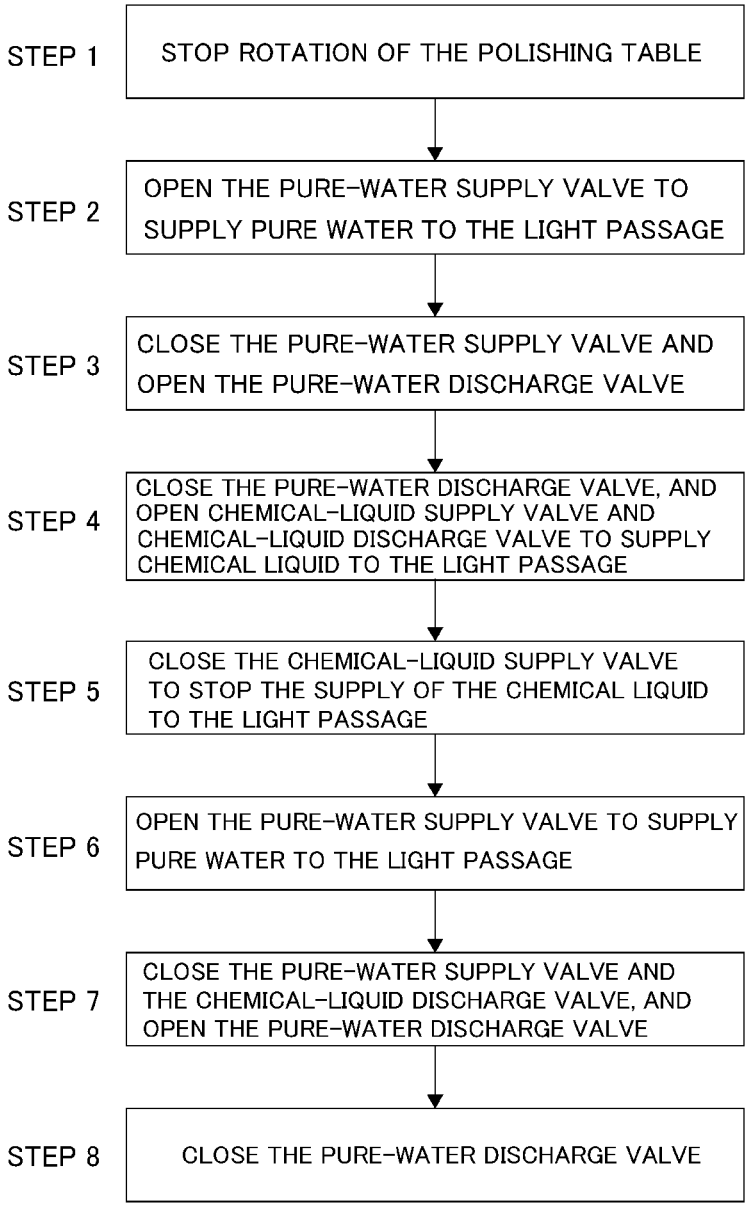
FIG. 6 is a flowchart showing still another embodiment of removing abrasive grains from the light passage.

FIG. 6 is a flowchart showing still another embodiment for removing the abrasive grains from the light passage 50A.

In step 1, after the wafer is polished, the rotation of the polishing table 3 is stopped.

In step 2, the valve controller 90 opens the pure-water supply valve 72 when the wafer is not present on the polishing pad 2. The chemical-liquid supply valve 78, the chemical-liquid discharge valve 79, the pure-water discharge valve 74, and the drying-gas supply valve 81 are closed. The pure water flows through the pure-water supply line 53 into the light passage 50A, further flows through the through-hole 51, and overflows onto the polishing pad 2. The slurry existing in the light passage 50A flows onto the polishing pad 2 together with the pure water.

In step 3, after a predetermined pure-water supply time has elapsed, the valve controller 90 closes the pure-water supply valve 72 and opens the pure-water discharge valve 74. The pure water in the through-hole 51 is discharged through the drain hole 50B and the pure-water discharge line 54.

In step 4, the valve controller 90 closes the pure-water discharge valve 74 and opens the chemical-liquid supply valve 78 and the chemical-liquid discharge valve 79. The chemical liquid is supplied through the chemical-liquid supply line 63 into the light passage 50A to fill the light passage 50A. Further, the chemical liquid flows through the through-hole 51 into the drain hole 50B and is discharged through the chemical-liquid discharge line 68. The abrasive grains firmly adhering to the inner surface of the light passage 50A are removed by the chemical liquid.

In step 5, the valve controller 90 closes the chemical-liquid supply valve 78 to stop the supply of the chemical liquid to the light passage 50A, while keeping the chemical-liquid discharge valve 79 open. The chemical liquid in the through-hole 51 is discharged through the drain hole 50B and the chemical-liquid discharge line 68.

In step 6, the valve controller 90 opens the pure-water supply valve 72 while keeping the chemical-liquid discharge valve 79 open. The pure water pushes out the chemical liquid remaining in the light passage 50A, and the chemical liquid is discharged together with the pure water through the drain hole 50B and the chemical-liquid discharge line 68. The light passage 50A is rinsed with the pure water.

In step 7, the valve controller 90 closes the pure-water supply valve 72 and the chemical-liquid discharge valve 79, and opens the pure-water discharge valve 74. The pure water in the through-hole 51 is discharged through the drain hole 50B and the pure-water discharge line 54.

In step 8, the valve controller 90 closes the pure-water discharge valve 74.

In this embodiment, the abrasive particles are removed by the chemical liquid, but the light passage 50A is not dried. The present embodiment is suitable in a case of removing the abrasive grains with the chemical liquid and rinsing the light passage 50A with the pure water, and then immediately polishing the next wafer.

Figure 7:
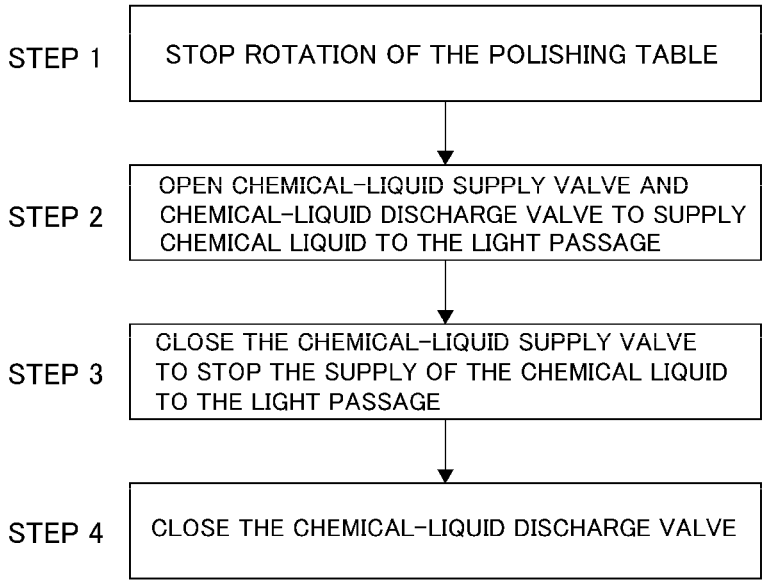
FIG. 7 is a flowchart showing still another embodiment of removing abrasive grains from the light passage.

FIG. 7 is a flowchart showing still another embodiment for removing the abrasive grains from the light passage 50A.

In step 1, after the wafer is polished, the rotation of the polishing table 3 is stopped.

In step 2, the valve controller 90 opens the chemical-liquid supply valve 78 and the chemical-liquid discharge valve 79 when the wafer is not present on the polishing pad 2. The pure-water supply valve 72, the pure-water discharge valve 74, and the drying-gas supply valve 81 are closed. The chemical liquid flows through the chemical-liquid supply line 63 into the light passage 50A, further flows through the through-hole 51, and overflows onto the polishing pad 2. The slurry existing in the light passage 50A flows onto the polishing pad 2 together with the chemical liquid. The abrasive grains firmly adhering to the inner surface of the light passage 50A are removed by the chemical liquid.

In step 3, the valve controller 90 closes the chemical-liquid supply valve 78 to stop the supply of the chemical liquid to the light passage 50A, while keeping the chemical-liquid discharge valve 79 open. The chemical liquid in the through-hole 51 is discharged through the drain hole 50B and the chemical-liquid discharge line 68.

In step 4, the valve controller 90 closes the chemical-liquid discharge valve 79.

The present embodiment is performed in a case of using a type of chemical liquid that does not necessitate the rinsing step of washing the chemical liquid away from the light passage 50A with the pure water. Also in this embodiment, the abrasive particles are removed by the chemical liquid, but the light passage 50A is not dried. The present embodiment is suitable in a case of removing the abrasive grains with the chemical liquid, and then immediately polishing the next wafer.

As described above, according to each of the above-described embodiments, the abrasive grains are removed from the light passage 50A with the chemical liquid or the pure water. The light can travel in the light passage 50A without being affected by the abrasive grains. As a result, the optical surface-monitoring device 40 can accurately measure a film thickness of a substrate, such as a wafer.

The cleaning method according to each of the above-described embodiments is performed in a state where the rotation of the polishing table 3 is stopped in order to prevent the chemical liquid and/or the pure water from scattering. Depending on the flow rate of the chemical liquid and/or the flow rate of the pure water, the cleaning method according to each of the above-described embodiments may be performed while the polishing table 3 is rotating.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A cleaning method comprising:

while supplying slurry containing abrasive grains onto a polishing pad supported by a rotating polishing table, placing a substrate in sliding contact with the polishing pad to polish the substrate;

during polishing of the substrate, directing light to the substrate through a light passage provided in the polishing table, and causing reflected light from the substrate to pass through the light passage;

terminating rotation of the polishing table after polishing of the substrate;

supplying a chemical liquid into the light passage when a polished substrate is not present on the polishing pad and when the polishing table is not rotating to remove the abrasive grains adhering to the light passage, the chemical liquid having a chemical property of etching an inner surface of the light passage; and after the polishing of the substrate and after the supplying of the chemical liquid is ended, supplying a drying gas into the light passage to dry the light passage.

2. The cleaning method according to claim 1, further comprising:

after supplying the chemical liquid into the light passage and before supplying the drying gas into the light passage, supplying pure water into the light passage.

3. The cleaning method according to claim 1, further comprising:

after terminating the rotation of the polishing table and before supplying the chemical liquid into the light passage, supplying pure water into the light passage.

4. A cleaning method comprising:

while supplying slurry containing abrasive grains onto a polishing pad supported by a rotating polishing table, placing a substrate in sliding contact with the polishing pad to polish the substrate;

during polishing of the substrate, directing light to the substrate through a light passage provided in the polishing table, and causing reflected light from the substrate to pass through the light passage;

terminating rotation of the polishing table after polishing of the substrate;

supplying pure water into the light passage when a polished substrate is not present on the polishing pad and when the polishing table is not in rotation to remove the abrasive grains adhering to the light passage; and after the polishing of the substrate and after the supplying of the pure water is ended, supplying a drying gas into the light passage to dry the light passage.

* * * * *